US007749319B2

(12) United States Patent
Inbe et al.

(10) Patent No.: US 7,749,319 B2
(45) Date of Patent: Jul. 6, 2010

(54) COMPOSITION FOR SURFACE CONDITIONING AND A METHOD FOR SURFACE CONDITIONING

(75) Inventors: Toshio Inbe, Tokyo (JP); Masahiko Matsukawa, Tokyo (JP); Kotaro Kikuchi, Tokyo (JP)

(73) Assignee: Chemetall GmbH, Frankfurt am Main (DE)

( * ) Notice: Subject to any disclaimer, the term of this patent is extended or adjusted under 35 U.S.C. 154(b) by 772 days.

(21) Appl. No.: 11/506,222

(22) Filed: Aug. 18, 2006

(65) Prior Publication Data

US 2007/0240604 A1 Oct. 18, 2007

(30) Foreign Application Priority Data

Aug. 19, 2005 (JP) ..... 2005-239231

(51) Int. Cl.

| | |
|---|---|
| ***C04B 14/00*** | (2006.01) |
| ***C04B 9/02*** | (2006.01) |
| ***C01B 25/00*** | (2006.01) |
| ***C09K 17/40*** | (2006.01) |
| ***B32B 7/12*** | (2006.01) |
| ***C23C 22/78*** | (2006.01) |

(52) U.S. Cl. ..... 106/401; 106/14.44; 106/287.17; 106/287.26; 148/254; 524/186

(58) Field of Classification Search ..... 106/401, 106/14.44, 287.17, 287.26; 148/254; 524/186
See application file for complete search history.

(56) References Cited

U.S. PATENT DOCUMENTS

| | | | | |
|---|---|---|---|---|
| 4,315,790 | A * | 2/1982 | Rattee et al. | 156/230 |
| 6,361,623 | B1 * | 3/2002 | Ishikura et al. | 148/254 |
| 6,562,142 | B2 * | 5/2003 | Barger et al. | 134/6 |
| 6,645,316 | B1 * | 11/2003 | Brouwer et al. | 148/253 |
| 6,692,583 | B2 * | 2/2004 | Bengston et al. | 148/261 |
| 2004/0011429 | A1 * | 1/2004 | Miyamoto et al. | 148/254 |

FOREIGN PATENT DOCUMENTS

| | | |
|---|---|---|
| JP | 10-245685 | 9/1998 |
| JP | 2000-096256 | 4/2000 |
| JP | 2004-068149 | 3/2004 |

* cited by examiner

*Primary Examiner*—Anthony J Green
*Assistant Examiner*—Pegah Parvini
(74) *Attorney, Agent, or Firm*—Dilworth & Barrese LLP

(57) ABSTRACT

A composition for surface conditioning includes bivalent or trivalent metal phosphate particles having a pH of 3 to 12, with $D_{50}$ of the particles being 3 μm or less and including an amine compound having a MW of 1000 or less, plus at least one metal alkoxide in a content of from 0.01 to 1000 parts by weight per 100 parts by weight of the solid content of the metal phosphate particles.

15 Claims, 1 Drawing Sheet

COMPOSITION FOR SURFACE CONDITIONING AND A METHOD FOR SURFACE CONDITIONING

CROSS-REFERENCE TO RELATED APPLICATIONS

This application is based upon and claims the benefit of priority from the prior Japanese Patent Application No. 2005-239231 filed on Aug. 19, 2005, the entire contents of which are incorporated herein by reference.

FIELD OF THE INVENTION

The present invention relates to a composition for surface conditioning, a method for producing the same, and a method for surface conditioning.

RELATED ART

Automotive bodies, home electric appliances and the like have been manufactured with metal materials such as steel plates, galvanized steel plates, and aluminum alloys. In general, after subjecting to a conversion treatment step as a pretreatment, a treatment such as coating is carried out. As such a conversion treatment, a phosphating is generally carried out. In the conversion treatment, a surface conditioning treatment is generally carried out as a preceding process for allowing minute and dense phosphate crystals to be deposited on the metal material surface.

Examples of known compositions for surface conditioning for use in such a surface conditioning treatment include treatment liquids containing titanium phosphate particles referred to as a Jernstedt salt, or bivalent or trivalent metal phosphate particles.

Japanese Unexamined Patent Application Publication No. 10-245685 discloses a pretreatment liquid for surface conditioning used before the phosphate conversion treatment of a metal which includes phosphate particles of at least one or more kinds of bivalent or trivalentmetals having a particle diameter of 5 μm or less, and an alkali metal salt or an ammonium salt, or a mixture thereof, and which has a pH adjusted to be 4 to 13.

Also, Japanese Unexamined Patent Application Publication No. 2000-96256 discloses a treatment liquid for surface conditioning used before the phosphate conversion treatment of a metal which includes one or more kinds of phosphate particles selected from salts of phosphoric acid containing one or more kinds of bivalent and/or trivalent metal, and any one of various accelerators.

Moreover, Japanese Unexamined Patent Application Publication No. 2004-068149 discloses a surface conditioning agent containing zinc phosphate which is characterized by including 500 to 20000 ppm zinc phosphate, and the zinc phosphate having an average particle diameter of 3 μm or less, the $D_{90}$ being 4 μm or less with a pH of 3 to 11.

However, in accordance with the development of novel materials and simplification of the treatment steps in recent years, there may be cases which such treatment liquids for surface conditioning cannot address satisfactorily, for example, in the case of the conversion treatment of conversion resistant metal materials such as high-tensile steel plates, or simultaneous processing of multiple kinds of different metal materials. In addition, the required level of corrosion resistance has been elevated, and the formation of a more dense conversion coating film has been desired. Hence, improvement of performances of the treatment liquid for surface conditioning, and upgrading of physical properties of the conversion treatment-coating film obtained by the conversion treatment with this liquid have been desired.

The phosphate particles included in the aforementioned pretreatment liquid for surface conditioning are obtained by pulverizing phosphate. In the aforementioned Japanese Unexamined Patent Application Publication No. 2004-068149, zinc phosphate is blended in a dispersion medium such as water or an organic solvent, and wet pulverization is conducted in the presence of a dispersant. However, in order to obtain the intended phosphate particles having a minute average particle diameter, there may be cases in which a long period of time, i.e., approximately 6 hours, is required for the dispersion. Accordingly, shortening of the dispersion time has been desired.

In the aforementioned Japanese Unexamined Patent Application Publication No. 2004-068149, it is disclosed that polyamine may be used as the dispersant, and that an amine-based neutralizing agent can be used for the purpose of neutralization of an anionic surfactant and an anionic resin as a polymeric dispersant. However, also in the cases in which these are used, a long period of time for the dispersion has been required for obtaining zinc phosphate particles having an intended average particle diameter.

SUMMARY OF THE INVENTION

In view of the circumstances described above, an object of the present invention is to provide a composition for surface conditioning which can form a conversion coating film that is more dense as compared with conventional ones, and can form a conversion coating film having a sufficient amount of the coating film on a contact part of different kinds of metals, or on a conversion resistant metal material such as a high-tensile steel plate.

Also, another object of the present invention is to provide a method for production of a composition for surface conditioning capable of providing phosphate particles having a predetermined particle diameter in a time period that is shorter as compared with conventional methods.

The composition for surface conditioning of the present invention includes bivalent or trivalent metal phosphate particles, and has a pH of 3 to 12, which is characterized by the $D_{50}$ of the bivalent or trivalent metal phosphate particles being 3 μm or less, and containing an amine compound having a molecular weight of 1000 or less. The bivalent or trivalent metal phosphate particle to be included in the composition for surface conditioning of the present invention is preferably zinc phosphate, while the amine compound is preferably a hydroxyamine compound having at least one hydroxyl group in one molecule.

It is preferred that the composition for surface conditioning of the present invention further contain a layered clay mineral. It is preferred that the composition for surface conditioning of the present invention further include a chelating agent. It is preferred that the composition for surface conditioning of the present invention further include a phenolic compound.

The method for production of the composition for surface conditioning of the present invention is characterized by including a step of subjecting a raw material phosphate of a bivalent or trivalent metal to wet pulverization in a dispersion medium in the presence of an amine compound having a molecular weight of 1000 or less.

The method for surface conditioning of the present invention is characterized by including a step of bringing the composition for surface conditioning to be in contact with a metal material surface.

Specifically, the following matters are provided according to the aspects of the present invention.

(1) A composition for surface conditioning including bivalent or trivalent metal phosphate particles and having a pH of 3 to 12, wherein the $D_{50}$ of the bivalent or trivalent metal phosphate particles is 3 μm or less, and the composition for surface conditioning includes an amine compound having a molecular weight of 1000 or less.

(2) A composition for surface conditioning according to (1) wherein the bivalent or trivalent metal phosphate particle is zinc phosphate.

(3) A composition for surface conditioning according to (1) or (2) wherein the amine compound is a hydroxyamine compound having at least one hydroxyl group in one molecule.

(4) A composition for surface conditioning according to (1), (2) or (3) further including a layered clay mineral.

(5) A composition for surface conditioning according to (1), (2), (3) or (4) further including a chelating agent.

(6) A composition for surface conditioning according to (1), (2), (3), (4) or (5) further including a phenolic compound.

(7) A method for production of a composition for surface conditioning including subjecting a raw material phosphate of a bivalent or trivalent metal to wet pulverization in a dispersion medium in the presence of an amine compound having a molecular weight of 1000 or less.

(8) A composition for surface conditioning obtained by the method for production according to (7).

(9) A method for surface conditioning including a step of bringing the composition for surface conditioning according to (1), (2), (3), (4), (5), (6), or (8) to be in contact with a metal material surface.

The term "composition for surface conditioning" referred to herein means to include both a "treatment liquid for surface conditioning" that is a treatment liquid for bringing into contact with the metal material actually in the surface conditioning treatment, and a "concentrated dispersion liquid" that is a dispersion liquid of the metal phosphate particles used for producing the treatment liquid for surface conditioning through dilution. The treatment liquid for surface conditioning is obtained by diluting the concentrated dispersion liquid in a solvent such as water to give a predetermined concentration, adding necessary additives thereto, and thereafter adjusting the pH of the liquid.

Furthermore, according to the present invention, the surface conditioning treatment is carried out after subjecting the metal material to a necessary pretreatment, and then a conversion treatment is carried out. In other words, the term "surface conditioning treatment" referred to herein means the first phosphating, which is a step for allowing metal phosphate particles to be adhered on a metal material surface.

In addition, the term "conversion treatment" means a second phosphate treatment subsequent to the surface conditioning treatment, which is a treatment for allowing the phosphate particles adhered on the metal material surface by the surface conditioning treatment to grow in the form of crystals. Moreover, the coating film of the metal phosphate formed by the surface conditioning treatment is herein referred to as a "phosphate coating film", while the coating film of metal phosphate particles formed by the conversion treatment is referred to as a "conversion coating film".

Hereinafter, the present invention will be explained in detail.

Composition for Surface Conditioning

The composition for surface conditioning of the present invention includes bivalent or trivalent metal phosphate particles, and an amine compound having a molecular weight of 1000 or less.

Metal Phosphate Particles

The aforementioned metal phosphate particles are to be the crystal nucleus for acquiring the surface conditioning function. It is believed that the reaction for the conversion treatment is accelerated by adhesion of these particles to the metal material surface in the surface conditioning treatment.

The bivalent or trivalent metal phosphate particle is not particularly limited, and examples thereof include e.g., particles of $Zn_3(PO_4)_2$, $Zn_2Fe(PO_4)_2$, $Zn_2Ni(PO_4)_2$, $Ni_3(PO_4)_2$, $Zn_2Mn(PO_4)_2$, $Mn_3(PO_4)_2$, $Mn_2Fe(PO_4)_2$, $Ca_3(PO_4)_2$, $Zn_2Ca(PO_4)_2$, $FePO_4$, $AlPO_4$, $CoPO_4$, $Co_3(PO_4)_2$ and the like. Among them, zinc phosphate particles are preferred in light of similarity to the crystals of the coating film in the phosphoric acid treatment, particularly zinc phosphate treatment, of the conversion treatment.

The $D_{50}$ of the aforementioned bivalent or trivalent metal phosphate particles is 3 μm or less. By setting $D_{50}$ to fall within the above range, a minute phosphate coating film in a sufficient amount of the coating film can be formed in a short time period of the surface conditioning treatment, which may lead to the possibility of formation of a dense conversion coating film. When the $D_{50}$ is greater than 3 μm, the dispersion stability of the metal phosphate particles in the treatment liquid for surface conditioning may be deteriorated, and thus the metal phosphate particles may be likely to sediment. The $D_{50}$ can be 1 μm or less, and further can be 0.2 μm or less, the lower limit is preferably 0.01 μm. A lower limit of the $D_{50}$ of less than 0.01 μm is not economical because of inferior production efficiency. More preferably, the lower limit of $D_{50}$ is 0.1 μm, while the upper limit is 1 μm.

In addition, the $D_{90}$ of the bivalent or trivalent metal phosphate particles is preferably 4 μm or less. By thus setting not only the $D_{50}$ but also the $D_{90}$, the proportion of the presence of phosphate particles having a large particle diameter is decreased. Accordingly, a dispersion liquid exhibiting a sharp distribution of the diameters in dispersion, and being in an extremely stable dispersion state can be obtained. When the $D_{90}$ is greater than 4 μm, the proportion of minute metal phosphate particles is consequently decreased, and thus a high-quality conversion coating film may be difficult to obtain. The $D_{90}$ can be 2.6 μm or less, and further 0.3 μm or less. The lower limit is preferably 0.01 μm. When the lower limit of the $D_{90}$ is less than 0.01 μm, the particles are likely to aggregate due to the phenomenon of overdispersion. More preferably, the lower limit of $D_{90}$ is 0.05 μm, while the upper limit is 2 μm.

In the composition for surface conditioning of the present invention, it is believed that the metal phosphate particles in the liquid can efficiently produce crystal nuclei because of the low proportion of large particles. Furthermore, it is expected that in the surface conditioning treatment step, more homogeneous crystal nuclei are formed due to the distribution of the diameters in dispersion being sharp, which may result in formation of a uniform metal phosphate crystal coating film in the following conversion treatment. The conversion-treated steel plate obtained in such a manner has a uniform and excellent surface quality, and this further suggests the expectation of an improvement of the properties of the treatment on bag-shaped parts of the metal material having a complex structure and on conversion resistant steel plates such as black steel scale plates.

When a means such as pulverizing is employed for providing a dispersion with a diameter of 3 μm or less, excessive pulverizing may cause reaggregation due to a relative lack of the dispersant as the specific surface area is increased. Hence, the dispersion stability may be deteriorated through forming large particles. Moreover, depending on the constituting ingredients and conditions of preparation of the composition for surface conditioning, a fluctuation in the dispersibility of the aforementioned phosphate may be generated, leading to the probability of causing problems of reaggregation of the minute particles, an increase in viscosity and the like. However, when the $D_{90}$ of the phosphate is 4 μm or less, the occurrence of the foregoing disadvantages can be suppressed.

The $D_{50}$ and the $D_{90}$ mean the diameter of the particles corresponding to 50% in terms of the volume and the diameter of the particles corresponding to 90% in terms of the volume, respectively. They are the diameters of the particle at the points of 50%, and 90%, respectively, in a cumulative curve as determined assuming that the total volume of the particles is 100% on the basis of the particle diameter distribution in the dispersion liquid. These values can be determined by the measurement of the particle diameter distribution using an optical diffraction type particle size analyzer (for example, name of article "LA-500", manufactured by Horiba, Ltd.). Herein, the reference to "average particle diameter" represents the $D_{50}$.

When the composition for surface conditioning of the present invention is a concentrated dispersion liquid, the content of the bivalent or trivalent metal phosphate particle accounts for preferably 5 to 80% by weight of the concentrated dispersion liquid. When the content is less than 5% by weight, production efficiency may be deteriorated, while when the content is greater than 80% by weight, the dispersion stability of the resulting concentrated dispersion liquid may not be sufficiently achieved. A more preferable lower limit is 10% by weight, and a still more preferable lower limit is 20% by weight. Additionally, a more preferable upper limit is 65% by weight, and a still more preferable upper limit is 50% by weight.

In contrast, when the composition for surface conditioning of the present invention is a treatment liquid for surface conditioning, the content of the bivalent or trivalent metal phosphate particles is preferably 50 to 20000 ppm. The treatment liquid for surface conditioning is produced by diluting the concentrated dispersion liquid at a dilution ratio of 5 to 10000-fold. When the content is less than 50 ppm, the phosphate to be the crystal nucleus may be deficient, and thus it is probable that the surface conditioning effect cannot be sufficiently achieved. Also, a content greater than 20000 ppm is not economical because an effect exceeding the desired effect cannot be achieved. With respect to the content, a lower limit of 150 ppm and an upper limit of 10000 ppm are more preferred, and a lower limit of 250 ppm and an upper limit of 2500 ppm are still more preferred.

Amine Compound

The amine compound to be included in the composition for surface conditioning of the present invention has a molecular weight of 1000 or less. Use of such an amine compound enables a conversion coating film to be suitably formed, in the case of use for a conversion resistant metal materials such as high-tensile steel plates, or also in the case of simultaneous use for multiple kinds of different metal materials such as aluminum-based metal materials, iron-based metal material and the like, in subsequently conducted conversion treatment.

When the amine compound has a molecular weight of greater than 1000, the object of the present invention may not be accomplished. The molecular weight is preferably 500 or less, and more preferably 200 or less.

The amine compound is not particularly limited as long as its molecular weight is 1000 or less, but the lower limit of the molecular weight of the amine compound is preferably 59 because too small a molecular weight may result in difficulty in handling, and may have high toxicity.

The amine compound is preferably an aliphatic amine, and examples of the compound which can be used include primary to tertiary aliphatic amine compounds. Such aliphatic amine compounds include alicyclic amine, and hydroxyamine compounds having at least one hydroxyl group in one molecule. Additionally, examples of the amine compound other than the aliphatic amine include hydroxyamine compounds other than aliphatic ones, heterocyclic amines, basic amino acids such as lysine, aromatic amine compounds such as aniline, amine sulfonic acid compounds and the like.

Furthermore, the amine compound may be any one of a monoamine, a polyamine having two or more amino groups in one molecule such as diamine, triamine, tetramine, and the like. Moreover, these amine compounds may be used alone, or two or more thereof may be used in combination. Among them, the amine compound is preferably a hydroxyamine compound in light of absorptivity to the metal phosphate particles, and affinity to water, and the like.

Examples of the hydroxyamine compound include e.g., aliphatic hydroxyamine compounds such as monoethanolamine, diethanolamine, dimethylethanolamine, methyldiethanolamine, triethanolamine, triisopropanolamine, and aminoethylethanolamine; hydroxyamine compounds other than aliphatic ones such as amine modified resol, and amine modified novolak, and the like. Among these, aliphatic hydroxyamine compounds are more preferred, and dimethylethanolamine and triethanolamine are particularly preferred in light of ease in achieving the advantageous effect of the present invention.

With respect to the content of the amine compound having a molecular weight of 1000 or less in the composition for surface conditioning of the present invention, the lower limit of 0.01 parts by weight and the upper limit of 1000 parts by weight per 100 parts by weight of the metal phosphate particle are preferred. When the content is less than 0.01 parts by weight, the advantageous effect of the present invention may not be achieved. Also, a content greater than 1000 parts by weight is not economical because an effect exceeding the desired effect cannot be achieved. A more preferable lower limit is 0.1 parts by weight, and a still more preferable lower limit is 0.5 parts by weight. In addition, a more preferable upper limit is 100 parts by weight, and a still more preferable upper limit is 50 parts by weight.

In addition, when the composition for surface conditioning of the present invention is the treatment liquid for surface conditioning, the content of the amine compound having a molecular weight of 1000 or less is preferably 1 to 10000 ppm. When the content is less than 1 ppm, the phosphate particles cannot be sufficiently covered, leading to insufficient absorption on the phosphate particles, which may cause secondary aggregation. In the case of the content being greater than 10000 ppm, it is not economical because an effect exceeding the desired effect cannot be achieved. A lower limit of 10 ppm and an upper limit of 5000 ppm are more preferred, and a lower limit of 10 ppm and an upper limit of 2500 ppm are still more preferred.

In the composition for surface conditioning of the present invention, the amine compound having a molecular weight of 1000 or less is preferably allowed to be present in the form of a free amine. More specifically, it is preferred to allow the amine compound to be in a state capable of minimizing interaction with an acid group such as a carboxyl group in the composition for surface conditioning of the present invention. To this end, measures may be taken such as: preventing other ingredients included in the composition for surface conditioning of the present invention from having an acid group; or in the case in which another ingredient has an acid group, neutralizing the acid group with a base having a higher basicity than the aforementioned amine compound, or increasing the amount of the amine compound to be greater than the equivalent of the acid group. In this manner, interaction of the amine compound having a molecular weight of 1000 or less with the metal phosphate particles is likely to occur, and thus the advantageous effect of the present invention is expected to be achieved.

Dispersion Medium

The composition for surface conditioning of the present invention contains a dispersion medium for allowing the aforementioned bivalent or trivalent metal phosphate particles to be dispersed. Examples of the dispersion medium which may be used include aqueous media including 80% by weight or more water, as well as media other than water such as various water soluble organic solvents. However, it is desired that the content of the organic solvent be as low as possible, which may be preferably 10% by weight or less, more preferably 5% by weight or less of the aqueous medium. A dispersion medium including water alone is also acceptable.

The water soluble organic solvent is not particularly limited, and examples thereof include e.g., alcoholic solvents such as methanol, ethanol, isopropanol and ethyleneglycol; ether based solvents such as ethyleneglycol monopropyl ether, butylglycol and 1-methoxy-2-propanol; ketone based solvents such as acetone and diacetone alcohol; amide based solvents such as dimethylacetamide and methylpyrrolidone; ester based solvents such as ethylcarbitol acetate, and the like. These may be used alone, or two or more thereof may be used in combination.

pH

The composition for surface conditioning of the present invention has a pH of 3 to 12. When the pH is less than 3, the aforementioned metal phosphate particles are likely to be dissolved, which may lead to instability of the liquid. When the pH is greater than 12, elevation of the pH of the bath for the conversion treatment subsequently carried out may occur, which may lead to defective conversion. The lower limit of the pH is preferably 6, and the upper limit is preferably 11.

Other Components

The composition for surface conditioning of the present invention may contain, in addition to the metal phosphate particles and the amine compound, various ingredients for use in compositions for surface conditioning as long as the function exhibited by the amine compound is not drastically inhibited.

Examples of the various additives include layered clay minerals, metal alkoxides, chelating agents, phenolic compounds and the like. Multiple ingredients among these may be concurrently used.

Layered Clay Mineral

By including the layered clay mineral in the composition for surface conditioning of the present invention, sedimentation of the metal phosphate particles may be suppressed, and thus dispersion stability is expected to be maintained. When the layered clay mineral is added, a tertiary structure including water is formed by the layered clay mineral, which is generally referred to as a card-house structure, and it is believed that this structure providing an effect to increase viscosity.

The layered clay mineral is not particularly limited, and examples thereof include e.g., smectites such as montmorillonite, beidellite, saponite, and hectorite; kaolinites such as kaolinite, and halloysite; vermiculites such as dioctahedral vermiculite, and trioctahedral vermiculite; micas such as teniolite, tetrasilicic mica, muscovite, illite, sericite, phlogopite, and biotite; hydrotalcite; pyrophilolite; layered polysilicic acid salts such as kanemite, makatite, ilerite, magadiite, and kenyaite, and the like. These layered clay minerals may be either naturally occurring minerals, or a synthetic minerals yielded by hydrothermal synthesis, a melt process, a solid phase process or the like.

The layered clay mineral preferably has a cation exchange capacity (CEC) of 60 meq/100 g or greater. The cation exchange capacity represents the total amount of negative charge of the layered clay mineral that contributes to cation exchange, and is measured herein by an ammonium acetate method or the like.

It is preferred that average particle diameter of the layered clay mineral in the dispersed state in ion exchanged water be 0.3 μm or less. When the average particle diameter is greater than 0.3 μm, the dispersion stability of the composition for surface conditioning may be deteriorated. Additionally, the average aspect ratio (mean value of maximum size/minimum size) of the layered clay mineral is preferably 10 or greater, and more preferably 20 or greater. When the average aspect ratio is less than 10, the dispersion stability may be deteriorated. The aforementioned average particle diameter is a value obtained by observation of an aqueous dispersion solution which had been subjected to lyophilization, with a transmission electron microscope (TEM), a scanning electron microscope (SEM) or the like.

Specific examples of the layered clay mineral having the cation exchange capacity of 60 meq/100 g or greater include smectites such as saponite, hectorite, stevensite, and sauconite; and layered clay minerals such as vermiculite. However, among them, examples of those likely to exhibit the average particle diameter in the aforementioned aqueous dispersion state being 0.3 μm or less include saponite, and hectorite (natural hectorite and/or synthetic hectorite).

In particular, saponite is preferred in light of having a small average particle diameter in the aqueous dispersion state, and having a high cation exchange capacity. Also, two or more of these may be concurrently used. By including such a layered clay mineral, the more excellent dispersion stability can be imparted, and also the dispersion efficiency can be improved.

These layered clay minerals may be either a naturally occurring mineral, or a synthetic mineral yielded by hydrothermal synthesis, a melt process, a solid phase process or the like. Additionally, intercalation compounds of the aforementioned layered clay mineral (pillared crystals and the like), as well as those subjected to an ion exchange treatment, or to surface modification such as a silane coupling treatment, a composite formation treatment with an organic binder, or the like can be used as needed. These layered clay minerals may be used alone, or two or more thereof may be used in combination.

The aforementioned saponite is a trioctahedral type layered clay mineral, which is represented by the following formula (I) and belongs to the smectite group.

$$[(Si_{8-a}Al_a)(Mg_{6-b}Al_b).O_{20}.(OH_4)]^-.M^+_{(a-b)} \quad (I)$$

wherein M is an exchangeable ion: Ca, Na, or K; and the relational expressions of $0<a<8$, $0<b<6$, and $a-b>0$ are satisfied.

The saponite may be modified, and examples of the modified saponite include e.g., zinc modified saponite, amine modified saponite, and the like. Examples of commercially available products of the saponite include e.g., Synthetic saponite ("Sumecton SA", name of article, manufactured by KUNIMINE INDUSTRIES CO., LTD.) and the like.

The aforementioned natural hectorite is a trioctahedral type layered clay mineral which is represented by the following formula (II).

$$[Si_8(Mg_{5.34}Li_{0.66})O_{20}(OH)_4M^+_{0.66}\cdot nH_2O] \quad (II)$$

Examples of commercially available products of the natural hectorite include e.g., "BENTON EW" and "BENTON AD" (both names are those of articles, manufactured by ELEMENTIS plc) and the like.

The aforementioned synthetic hectorite resembles an unlimited expanding layer type trioctahedral hectrite which has an expanding lattice in the crystal three-layered structure, and is represented by the following formula (III).

$$[Si_8(Mg_aLi_b)O_{20}(OH)_cF_{4-c}]^{X-}M^{X+} \quad (III)$$

wherein $0<a\leqq 6$, $0<b\leqq 6$, $4<a+b<8$, $0\leqq c<4$, $x=12-2a-b$; and M is Na in most cases.

The synthetic hectorite is constituted from magnesium, silicon, and sodium as principal ingredients, and a slight amount of lithium and fluorine.

Examples of commercially available products of the synthetic hectorite include e.g., names of articles "Laponite B", "Laponite S", "Laponite RD", "Laponite RDS", "Laponite XLG", "Laponite XLS" and the like manufactured by ROOKWOOD Additives Ltd. These are in the state of white powders, and readily form sols ("Laponite S", "Laponite RDS", "Laponite XLS") or gels ("Laponite B", "Laponite RD", "Laponite XLG") upon addition to water. Additionally, "Lucentite SWN" of CO—OP Chemical Co., Ltd. can be also mentioned as an example. These natural hectorite and synthetic hectorites may be used alone, or two or more thereof may be used in combination.

When the composition for surface conditioning of the present invention is the concentrated dispersion liquid, the content of the layered clay mineral is preferably 0.01 to 1000 parts by weight per 100 parts by weight of the solid content of the metal phosphate particle. When the content is less than 0.01 parts by weight, the effect of suppressing sedimentation may not be sufficiently achieved. Also, a content greater than 1000 parts by weight is not economical because an effect exceeding the desired effect cannot be achieved. With respect to the content, a lower limit of 0.1 parts by weight and an upper limit of 100 parts by weight are more preferred, and a lower limit of 0.5 parts by weight and an upper limit of 50 parts by weight are still more preferred.

In contrast, when the composition for surface conditioning of the present invention is the treatment liquid for surface conditioning, it is preferred that the content be 1 to 10000 ppm. A content out of this range may result in inexpedience that is similar to the case of the concentrated dispersion liquid. With respect to the content, a lower limit of 10 ppm and an upper limit of 1000 ppm are more preferred, and a lower limit of 10 ppm and an upper limit of 250 ppm are still more preferred.

Metal Alkoxide

The composition for surface conditioning of the present invention may contain at least one metal alkoxide selected from the group consisting of silane alkoxide, titanium alkoxide, and aluminum alkoxide.

The metal alkoxide is not particularly limited as long as it is a compound having a M-OR bond, and examples thereof include e.g., those represented by the following general formula (IV):

$$R^1\text{-}M\text{-}(R^2)_n(OR^2)_{3-n} \quad (IV)$$

wherein M represents silicon, titanium or aluminum; $R^1$ represents an alkyl group having 1 to 6 carbon atoms and being unsubstituted or substituted with an organic group, an epoxyalkyl group having 1 to 11 carbon atoms, an aryl group, an alkenyl group having 1 to 11 carbon atoms, an aminoalkyl group having 1 to 5 carbon atoms, a mercaptoalkyl group having 1 to 5 carbon atoms, or a halogenoalkyl group having 1 to 5 carbon atoms; $R^2$ represents an alkyl group having 1 to 6 carbon atoms; and n is 0, 1, or 2.

The metal alkoxide as described above is preferably an alkoxysilane compound having at least one mercapto group or (meth)acryloxy group.

The alkoxysilane compound is not particularly limited as long as it can be used in a water-based system, and examples thereof include e.g., vinylmethyldimethoxysilane, vinyltrimethoxysilane, vinylethyldiethoxysilane, vinyltriethoxysilane, 3-aminopropyltriethoxysilane, 3-glycidoxypropyltrimethoxysilane, 3-(meth)acryloxypropyltrimethoxysilane, 3-mercaptopropyltrimethoxysilane, N-(1,3-dimethylbutylidene)-3-(triethoxysilyl)-1-propaneamine, N,N'-bis[3-(trimethoxysilyl)propyl]ethylenediamine, N-(β-aminoethyl)-γ-aminopropylmethyldimethoxysilane, N-(β-aminoethyl)-3-aminopropyltrimethoxysilane, 3-aminopropyltrimethoxysilane, γ-glycidoxypropyltrimethoxysilane, 3-glycidoxypropyltriethoxysilane, 3-glycidoxypropylmethyldimethoxysilane, 2-(3,4-epoxycyclohexyl)ethyltrimethoxysilane, 3-methacryloxypropyltriethoxysilane, 3-mercaptopropyltriethoxysilane, N-[2-(vinylbenzylamino)ethyl]-3-aminopropyltrimethoxysilane, and the like. These may be used alone, or two or more thereof may be used in combination.

Among them, those having at least one mercapto group or (meth)acryloxy group in one molecule of the metal alkoxide is preferred, and for example, 3-mercaptopropylmethyldimethoxysilane, 3-mercaptopropylmethyldiethoxysilane, 3-(meth)acryloxypropylmethyltrimethoxysilane, or 3-(meth) acryloxypropylmethyltriethoxysilane is particularly preferred.

When the composition for surface conditioning of the present invention is the concentrated dispersion liquid, the content of the metal alkoxide is preferably 0.01 to 1000 parts by weight per 100 parts by weight of the solid content of the metal phosphate particle. When the content is less than 0.01 parts by weight, the pulverizing effect in dispersion and it is expected that there will be insufficient surface conditioning because the amount of absorption on the metal phosphate particles becomes insufficient. A content of 1000 parts by weight or greater is not economical because an effect exceeding the desired effect cannot be achieved. With respect to the content, a lower limit of 0.1 parts by weight and an upper limit of 100 parts by weight are more preferred, and a lower limit of 0.5 parts by weight and an upper limit of 20 parts by weight are still more preferred.

When the composition for surface conditioning of the present invention is the treatment liquid for surface conditioning, it is preferred that the content of the metal alkoxide be preferably 1 to 1000 ppm. A content out of this range may result in inexpedience that is similar to the case of the concentrated dispersion liquid. With respect to the content, a lower limit of 10 ppm and an upper limit of 500 ppm are more preferred, and a lower limit of 10 ppm and an upper limit of 250 ppm are still more preferred.

Chelating Agent

The composition for surface conditioning of the present invention may contain a chelating agent. By including the chelating agent, more excellent dispersion stability can be imparted, and further, the properties for dispersion stability can also be improved. More specifically, even in the case in which the treatment liquid for surface conditioning of the present invention is contaminated with a magnesium ion or a calcium ion included in water for dilution, aggregation of the metal phosphate particles does not occur, and thus the dispersion stability in the treatment liquid for surface conditioning can be improved.

The chelating agent is not particularly limited, but examples thereof include e.g., EDTAs, polyacrylic acids, organic acids such as citric acid, condensed phosphoric acids, phosphonic acids, chelating resins such as CMC, fillers having a chelating effect such as zeolite, silicate and condensed aluminum phosphate, and the like.

The chelating agent may not be included when the composition for surface conditioning of the present invention is the concentrated dispersion liquid because its effect should be realized in dilution. When the composition for surface conditioning of the present invention is the treatment liquid for surface conditioning, it is preferred that the content of the chelating agent be 1 to 10000 ppm. When the content is less than 1 ppm, hard components in tap water cannot be sufficiently chelated, and thus metal polycations such as calcium ions that are the hard components may cause aggregation of the metal phosphate particles. Even if the content is greater than 10000 ppm, an effect exceeding the desired effect cannot be achieved, and it is probable that a reaction with the active ingredient of the conversion treatment agent may occur to thereby inhibit the conversion treatment reaction. With respect to the content, a lower limit of 10 ppm and an upper limit of 1000 ppm are more preferred, and a lower limit of 20 ppm and an upper limit of 500 ppm are still more preferred.

Phenolic Compound

The composition for surface conditioning of the present invention may include a phenolic compound. By using the phenolic compound in combination with the composition for surface conditioning, the adhesion property of the metal phosphate particles to the metal material is improved. In particular, in addition to improvement of the reactivity in the conversion treatment of the conversion resistant metal material such as an aluminum-based metal material or a high-tensile steel plate, an effect to improve the stability of the composition for surface conditioning may be obtained. In other words, the addition of the phenolic compound is expected to improve the storage stability in the case of preservation for a long period of time in a concentrated dispersion liquid state, and the stability of the bath for the surface conditioning treatment including the treatment liquid for surface conditioning. In addition, even in the case in which the liquid is contaminated with a hard component such as a calcium ion, a magnesium ion or the like derived from water for dilution, aggregation of the metal phosphate particles is expected to be prevented via an action that is similar to the chelating agent as described above.

Examples of the phenolic compound include e.g., compounds having two or more phenolic hydroxyl groups such as catechol, gallic acid, pyrogallol and tannic acid, or phenolic compounds having a basic skeleton of above mentioned compounds (for example, polyphenolic compounds involving flavonoid, tannin, catechin and the like, polyvinyl phenol as well as water soluble resol, novolak resins, and the like), lignin, and the like. Among them, tannin, gallic acid, catechin and pyrogallol are particularly preferred. The aforementioned flavonoid is not particularly limited, and examples thereof include e.g., flavone, isoflavone, flavonol, flavanone, flavanol, anthocyanidin, aurone, chalcone, epigallocatechin gallate, gallocatechin, theaflavin, daidzin, genistin, rutin, myricitrin, and the like.

The aforementioned tannin is a generic name of aromatic compounds which have a complicated structure having many phenolic hydroxyl groups, and which are widely distributed in the plant kingdom. The aforementioned tannin may be either a hydrolyzed tannin or a condensed tannin.

Examples of the tannin include hamameli tannin, persimmon tannin, tea tannin, oak gall tannin, gallnut tannin, myrobalan tannin, divi-divi tannin, algarovilla tannin, valonia tannin, catechin tannin, and the like. The aforementioned tannin may be also a hydrolyzed tannin decomposed by a process such as hydrolysis or the like of a tannin that was present in a plant.

Examples of the aforementioned tannin which may be used also include commercially available ones such as e.g., "Tannic acid extract A", "B tannic acid", "N tannic acid", "Industrial tannic acid", "Purified tannic acid", "Hi tannic acid", "F tannic acid", "Official tannic acid" (all names are of articles, manufactured by Dainippon Pharmaceutical Co., Ltd.), "Tannic acid: AL" (name of article, manufactured by Fuji Chemical Industry Co., Ltd.), and the like. Also, two or more of the aforementioned tannins may be simultaneously used. The aforementioned lignin is a network polymer compound having phenol derivative, to which a propyl group is bound, as a base unit.

When the composition for surface conditioning of the present invention is the concentrated dispersion liquid, the content of the phenolic compound is preferably 0.01 to 1000 parts by weight per 100 parts by weight of the solid content of the metal phosphate particles. When the content is less than 0.01 parts by weight, the effect of adhesion of the metal phosphate particles to the metal material is not enough because the absorption on the particles becomes insufficient, which may lead concern that the expected effect of addition will not be obtained. Also, the content of 1000 parts by weight or greater is not economical because an effect exceeding the desired effect cannot be achieved. With respect to the content, a lower limit of 0.1 parts by weight and an upper limit of 100 parts by weight are more preferred, and a lower limit of 0.5 parts by weight and an upper limit of 25 parts by weight are still more preferred.

In contrast, when the composition for surface conditioning of the present invention is the treatment liquid for surface conditioning, it is preferred that the content of the phenolic compound be 1 to 1000 ppm. A content out of this range may result in inexpedience that is similar to the case of the concentrated dispersion liquid. With respect to the content, a lower limit of 10 ppm and an upper limit of 500 ppm are more preferred, and a lower limit of 10 ppm and an upper limit of 250 ppm are still more preferred.

Other Additives

Examples of additives other than the ingredients described hereinabove include monosaccharides, polysaccharide thickeners such as xanthan gum, and the like. These may be used alone, or two or more thereof may be used in combination. With respect to the aforementioned various additives, the kind, amount of addition and the like can be freely selected.

The composition for surface conditioning of the present invention may further include a surfactant, a deforming agent, an antirusting agent, a preservative, and the like in a range such as not to hamper the advantageous effect of the present invention, in addition to the foregoing ingredients.

Surfactant

As the surfactant, an anionic surfactant or a nonionic surfactant may be exemplified.

The nonionic surfactant is not particularly limited, and examples thereof include e.g., polyoxyethylene alkyl ether, polyoxyalkylene alkyl ether, polyoxyethylene derivatives, oxyethylene-oxypropylene block copolymers, sorbitan fatty acid esters, polyoxyethylene sorbitan fatty acid esters, polyoxyethylene sorbitol fatty acid esters, glycerine fatty acid esters, polyoxyethylene fatty acid esters, polyoxyethylene alkylamine, alkylalkanode amide, nonylphenol, alkylnonylphenol, polyoxyalkylene glycol, alkylamine oxide, acetylenediol, polyoxyethylene nonylphenyl ether, silicon based surfactants such as polyoxyethylene alkylphenyl ether-modified silicon, nonionic surfactants which are selected from fluorine-based surfactants prepared through substitution of at least one hydrogen atom in a hydrophobic group of a hydrocarbon-based surfactant with a fluorine atom and which have hydrophilic lipophilic balance (HLB) of 6 or greater. Among them, polyoxyethylene alkyl ether and polyoxyalkylene alkyl ether having HLB of 6 or greater are preferred in light of obtaining further improved effects of the present invention.

The anionic surfactant is not particularly limited, and examples thereof include e.g., fatty acid salts, alkylsulfuric acid ester salts, alkyl ether sulfuric acid ester salts, alkylbenzene sulfonate, alkylnaphthalene sulfonate, alkylsulfosuccinate, alkyldiphenyl ether disulfonate, polybisphenol sulfonate, alkylphosphate, polyoxyethylalkyl sulfuric acid ester salts, polyoxyethylalkylallylsulfuric acid ester salts, alpha-olefin sulfonate, methyl taurine acid salts, polyaspartate, ether carboxylate, naphthalene sulfonic acid-formalin condensates, polyoxyethylene alkylphosphate esters, alkyl ether phosphoric acid ester salts, and the like. Among them, alkyl ether phosphoric acid ester salts are preferred in light of obtaining further improved effects of the present invention.

However, as described above in the explanation of the amine compound, the acid group carried by the anionic surfactant may interact with the amine compound having a molecular weight of 1000 or less to thereby lead to failure in exhibiting sufficient function of the amine compound. Hence, it is preferred to neutralize the acid group carried by the anionic surfactant with ammonia or an amine based neutralizing agent such that the amine compound having a molecular weight of 1000 or less is present in the form of free amine. The amount of the amine based neutralizing agent to be used in the neutralization varies depending on the type of the acid group carried by the anionic surfactant and the amine based neutralizing agent, as well as the amine compound having a molecular weight of 1000 or less; therefore, it is preferred that conditions be set appropriately when the anionic surfactant is used.

Examples of the amine based neutralizing agent include e.g., diethylamine (DEA), triethylamine (TEA), monoethanolamine (META), diethanolamine (DETA), triethanolamine (TETA), dimethylethanolamine (DMEA), diethylethanolamine (DEEA), isopropylethanolamine (IPEA), diisopropanolamine (DIPA), 2-amino-2-methylpropanol (AMP), 2-(dimethylamino)-2-methylpropanol (DMAMP), morpholine (MOR), N-methylmorpholine (NMM), N-ethylmorpholine (NEM), and the like. Among them, 2-amino-2-methylpropanol (AMP) is preferably used.

Examples of the amine based neutralizing agent may be included in those of the amine compound having a molecular weight of 1000 or less. In other words, the amine based neutralizing agent and the amine compound having a molecular weight of 1000 or less may be the same or different.

The anionic surfactant or nonionic surfactant may not be included similarly to the chelating agent as described above, when the composition for surface conditioning of the present invention is the concentrated dispersion liquid. When the composition for surface conditioning of the present invention is the treatment liquid for surface conditioning, it is preferred that the content of the anionic surfactant or the nonionic surfactant be 3 to 500 ppm. When the content falls within this range, the advantageous effect of the present invention can be favorably realized. With respect to the content, a lower limit of 5 ppm and an upper limit of 300 ppm are more preferred. The surfactant may be used alone, or two or more thereof may be used in combination.

Metal Nitrite Compound

To the composition for surface conditioning of the present invention can be added a bivalent or trivalent metal nitrite compound as needed for further suppressing the generation of rust.

Alkali Salt

To the composition for surface conditioning of the present invention may be added an alkali salt such as soda ash for the purpose of further stabilizing the metal phosphate particles to form a minute conversion coating film in the phosphate conversion treatment step subsequently carried out.

Method for Production of Composition for Metal Surface Conditioning

The method for production of the composition for surface conditioning of the present invention is characterized by including subjecting a raw material phosphate of a bivalent or trivalent metal to wet pulverization in a dispersion medium in the presence of an amine compound having a molecular weight of 1000 or less.

With respect to the amine compound having a molecular weight of 1000 or less, the above explanation concerning the composition for metal surface conditioning may be applied. In the meantime, as the raw material phosphate of the bivalent or trivalent metal, a hydrate of the phosphate can be used. In the case of zinc phosphate, there are tetrahydrate, dihydrate, and monohydrates as the hydrate of a phosphate; however, the tetrahydrate represented by $Zn_3(PO_4)_2.4H_2O$ is the most common among these. This tetrahydrate can be obtained by, for example, mixing diluted liquids of zinc sulfate and disodium hydrogenphosphate at a molar ratio of 3:2 followed by heating, or allowing diluted aqueous phosphoric acid solution and zinc oxide or zinc carbonate to react, respectively. The thus resulting tetrahydrate is generally in a colorless and crystalline solid form, but a commercially available product in the form of a white powder may be directly used. Furthermore, another raw material phosphate of the bivalent or trivalent metal which can be used is the nonhydrate.

The shape of the raw material phosphate of the bivalent or trivalent metal is not particularly limited, but one having an arbitrary shape can be used. Although commercially available products are generally in the form of a white powder, the shape of the powder may be any one such as minute particulate, platy, squamous, or the like. Also, the particle diameter of the raw material phosphate is not particularly limited, but in general, powders exhibiting a $D_{50}$ of approximately several micrometers (μm) may be used. Alternatively, ones having a primary particle diameter of several tens of micrometers are also acceptable. Products commercially available as rust preventive pigments, particularly such products having an improved buffering action by treating to impart basicity, may be suitably used.

In the method for production of the composition for surface conditioning of the present invention, dispersion is executed in the dispersion medium described above until the raw material phosphate of the bivalent or trivalent metal has a predetermined particle diameter. This process is referred to as wet pulverization. Upon the wet pulverization, by allowing the amine compound having a molecular weight of 1000 or less to be present, this amine compound effectively contributes to dispersion of the metal phosphate. Accordingly, a metal phosphate having an intended particle diameter can be obtained in a short period of time. Although the wet pulverization can be also conducted using other dispersants without allowing the amine compound having a molecular weight of 1000 or less to be present, the effect cannot be realized in such a case. However, an excellent effect from the composition for surface conditioning can be realized by adding an amine compound having a molecular weight of 1000 or less after executing dispersion until the particle diameter reaches a predetermined size.

It is preferred that the amount of the raw material phosphate of the bivalent or trivalent metal used in the method for production of the composition for surface conditioning of the present invention account for 5 to 80% by weight of total amount of the resulting dispersion liquid. An amount less than 5% by weight may result in deteriorated efficiency of production, while an amount exceeding 80% by weight may lead to the probability of failure in achieving sufficient dispersion stability of the resulting concentrated dispersion liquid. The lower limit is more preferably 10% by weight, and still more preferably 20% by weight. Moreover, the upper limit is more preferably 65% by weight, and still more preferably 50% by weight. When the amine compound having a molecular weight of 1000 or less is not allowed to be present, use of the raw material phosphate of the metal at such a high concentration is extremely difficult.

In the meantime, in connection with the amount of the amine compound having a molecular weight of 1000 or less used in the method for production of the composition for surface conditioning of the present invention, it is preferred that the lower limit be 0.01 parts by weight, and the upper limit be 1000 parts by weight per 100 parts by weight of the raw material metal phosphate particle. When the amount is less than 0.01 parts by weight, the advantageous effect of the present invention may not be realized. In contrast, an amount greater than 1000 parts by weight is not economical because an effect exceeding the disired effect cannot be achieved. The lower limit is more preferably 0.1 parts by weight, and still more preferably 0.5 parts by weight. Moreover, the upper limit is more preferably 100 parts by weight, and still more preferably 50 parts by weight.

In addition, in the method for production of the composition for surface conditioning of the present invention, wet pulverization may be conducted in the dispersion medium to which additives and other ingredients are added together with the amine compound. Examples of such additives include various ingredients generally used in compositions for surface conditioning such as layered clay minerals, chelating agents, metal alkoxide, and phenolic compounds. Meanwhile, examples of the other ingredients include surfactants, deforming agents, rust preventive agents, preservatives, and the like. With respect to substances and amount of use of these ingredients, the above explanation concerning the composition for surface conditioning of the present invention can be applied in its entirety.

In the method for production the of the composition for surface conditioning of the present invention, the method of the wet pulverization is not particularly limited, but a common means for wet pulverization can be employed. For example, any one of beads mills typified by the disc type, pin type and the like, high-pressure homogenizers, medialess dispersion machines typified by ultrasonic dispersion machines can be used. Also, the wet pulverization may be conducted in a dispersion medium other than the aqueous medium, and thereafter, the dispersion medium can be subjected to solvent replacement with an aqueous medium.

It is preferred that the $D_{50}$ of the bivalent or trivalent metal phosphate particles in the dispersion medium obtained by the method for production of the composition for surface conditioning of the present invention be 3 μm or less. A preferable lower limit is 0.01 μm. When the $D_{50}$ is out of this range, problems may occur with the stability, or a failure in achieving the excellent performance as a composition for surface conditioning, may be probable In the method for production of the composition for surface conditioning of the present invention, the $D_{50}$ of the bivalent or trivalent metal phosphate particles can be regulated in the range of 3 μm or less to meet the intended use. Accordingly, an aqueous dispersion liquid that is excellent in dispersion stability can be obtained. The $D_{50}$ of the bivalent or trivalent metal phosphate particles can be 1 μm or less, or further, 0.2 μm or less.

In the wet pulverization, it is preferred that the $D_{90}$ of the resulting bivalent or trivalent metal phosphate particles be monitored to be 4 μm or less. Accordingly, excessive dispersion can be prevented, and the aggregation as well as thickening, or reaggregation of minute particles can be prevented. In addition, it is desirable to select compounding and dispersion conditions which do not cause excessive dispersion.

In connection with the $D_{90}$ of the metal phosphate particles obtained by the method for production of the composition for surface conditioning of the present invention, it is preferred that the lower limit be 0.01 μm, and the upper limit be 4 μm. When the $D_{90}$ is less than 0.01 μm, aggregation of the particles is likely to occur due to the phenomenon of excessive dispersion. When the $D_{90}$ is greater than 4 μm, the proportion of minute metal phosphate particles is decreased; therefore, it is not adequate in obtaining a conversion coating film with high quality. The lower limit is more preferably 0.05 μm, and the upper limit is more preferably 2 μm.

In the method for production of the composition for surface conditioning of the present invention, a dispersion wherein the $D_{50}$ is 3 μm or less in the dispersion medium can be obtained in a short period of time even if particles exhibiting a $D_{50}$ of greater than 3 μm or those having a primary particle diameter of several ten micrometers are used as the raw material phosphate of the metal. This is because the primary particle diameter of the bivalent or trivalent metal phosphate particles can be decreased by conducting wet pulverization according to the process as described above, without using bivalent or trivalent metal phosphate particles originally having a small primary particle diameter.

In the method for production of the composition for surface conditioning of the present invention, it is preferred to terminate the wet pulverization at the instant when the average particle diameter of the phosphate particle reaches the intended value. According to the method for production of the composition for surface conditioning of the present invention, the time period for conducting the wet pulverization can be shortened. Although clear reference cannot be made because specific time period may vary depending on the performance of the instrument, there may be cases in which the time period for dispersion can be decreased to half or less when the same instrument is used. For making the average particle diameter of the phosphate particles be the intended value, at least 30 minutes will be necessary.

By adding a predetermined amount of necessary additives and other ingredients to the dispersion liquid obtained by conducting the wet pulverization as described above, the concentrated dispersion liquid is obtained. In the case in which the necessary additives and other ingredients are added in the course of the wet pulverization, the concentrated dispersion liquid will be obtained through conducting the wet pulverization. Also, the amine compound having a molecular weight of 1000 or less can be added in this stage. This involves the case of further adding the amine compound in an attempt to adjust the amount thereof, in addition to the case as described above in which the amine compound is not used in the course of the wet pulverization.

In the method for production of the composition for surface conditioning of the present invention, the concentrated dispersion liquid obtained as described above is diluted with water at a dilution ratio of 5 to 10000-fold to adjust the concentration to a preferable level for the treatment liquid for surface conditioning. In this step, or following the dilution, necessary additives and the other additives are added in a predetermined amount, and finally, the pH is adjusted to be 3 to 12. Accordingly, the treatment liquid for surface conditioning is obtained. The resulting treatment liquid for surface conditioning is also one aspect of the present invention.

Method for Surface Conditioning

The method for surface conditioning of the present invention includes a step of bringing the treatment liquid for surface conditioning in contact with a metal material surface (the first phosphating step). Hence, minute particles of the bivalent or trivalent metal phosphate can be adhered in a sufficient amount to the surface of not only the iron-based and zinc-based metal materials but also conversion resistant metal materials such as aluminum-based metal materials and high-tensile steel plates, and a favorable conversion coating film is formed in the following conversion treatment step (the second phosphating step). Also, different kinds of metal materials having a contact part of different kinds of metals such as, for example, an iron or zinc-based metal material and an aluminum-based metal material can be concurrently treated, and thus the conversion coating film in a sufficient amount of the coating film can be formed on the metal material surface in the conversion treatment step.

Surface Conditioning Treatment Step

The process for bringing the treatment liquid for surface conditioning into contact with the metal material surface in the above method for surface conditioning is not particularly limited, but a conventionally known method such as dipping or spraying can be freely employed.

The metal material to be subjected to the surface conditioning is not particularly limited, and the process is applicable to a variety of metals generally subjected to the phosphate conversion treatment, such as, for example, galvanized steel plates, aluminum-based metal materials such as aluminum or aluminum alloys, magnesium alloys, or iron-based metal materials such as cold-rolled steel plates and high-tensile steel plates. Also, it is suitably applicable to usage in which different kinds of metal materials such as, for example, an iron steel or galvanized steel plate and an aluminum or aluminum alloy-based metal material are simultaneously subjected to the treatment.

Moreover, using the treatment liquid for surface conditioning of the present invention, a step of surface conditioning in combination with degreasing can be carried out. Accordingly, the step for washing with water following a degreasing treatment can be omitted. In the aforementioned step of surface conditioning in combination with degreasing, a known inorganic alkali builder, an organic builder or the like may be added for the purpose of improving the detergency. Also, a known condensed phosphate or the like may be added. In the surface conditioning as described above, the contact time of the treatment liquid for surface conditioning with the metal material surface, and the temperature of the treatment liquid for surface conditioning are not particularly limited, but the process can be performed under conventionally known conditions.

Conversion Treatment Step

After performing the surface conditioning, the conversion treatment is carried out to enable production of a conversion treated metal plate. The process for the conversion treatment is not particularly limited, but any one of various known processes such as a dipping treatment, a spraying treatment, or an electrolytic treatment can be employed. Multiple kinds of these may be conducted in combination.

Also with regard to the metal phosphate constituting the conversion coating film to be deposited on the metal material surface, it is not particularly limited as long as it is a metal phosphate, and examples thereof include zinc phosphate, iron phosphate, manganese phosphate, zinc-calcium phosphate and the like, but are not limited thereto. Among them, zinc phosphate is preferred. In the conversion treatment, the contact time of the conversion treatment agent with the metal material surface, and the temperature of the conversion treatment agent are not particularly limited, and the treatment can be performed under conventionally known conditions.

Coating Step

After carrying out the aforementioned surface conditioning and the aforementioned conversion treatment, a coated steel plate can be produced by further carrying out coating. The coating process is generally electrodeposition coating.

The paint for use in the coating is not particularly limited, but may be of various types generally used in coating of a conversion treated metal plate, and examples thereof include e.g., epoxymelamine paints, as well as paints for cation electrodeposition, polyester-based intermediate coating paint and polyester-based top coating paints, and the like. A known process may be employed in which after the conversion treatment, a washing step is carried out prior to the coating.

The composition for surface conditioning of the present invention enables different kinds of metal joined or contacted materials to be concurrently subjected to a surface conditioning treatment, and subsequently permits formation of the conversion coating film in a sufficient amount of the coating film after the conversion treatment. Also, even in the case in which the composition for surface conditioning of the present invention is applied to a conversion resistant metal material such as a high-tensile steel plate, the conversion coating film in a sufficient amount of the coating film can be formed after the conversion treatment. In addition, it is also excellent in dispersion stability.

This is believed to result from the fact that the composition for surface conditioning of the present invention includes ascertain amine compound together with the metal phosphate particles having a minute particle diameter. More specifically, in the composition for surface conditioning of the present invention, the certain amine compound as described above functions as a dispersant of the metal phosphate particles to improve the dispersion stability thereof. Meanwhile, upon the surface conditioning, it is believed that the amine compound interacts with the metal, which is a subject to be treated, via a hydrogen bond or the like to thereby enable the phosphate particles to be efficiently adhered to the metal surface. Particularly, this effect is expected to be large when the amine compound has a hydroxyl group. Such improvement of the surface conditioning performance is believed to lead to formation of a conversion coating film that is more dense than conventional ones, and to the formation of the conversion coating film in a sufficient amount of the coating film on a contact part of different kinds of metals or on a conversion resistant metal material such as a high-tensile steel plate.

Furthermore, the method for production of the composition for surface conditioning of the present invention can provide phosphate particles having a predetermined particle diameter in a period of time that is shorter than conventional methods. It is believed that by allowing the above specified amine compound to be present in the wet pulverization, the amine compound interacts with the surface of the pulverized phosphate particles to thereby serve as a dispersant. In the prior art, polymer molecules that cover whole particles were often utilized as the dispersant; however, is it believed that use of the amine compound that is smaller than the polymer molecules enables a minute dispersion state to be formed. Also, by using the amine compound, production of a composition for surface conditioning was enabled at a concentration higher than that in conventional methods.

These advantageous effects cannot be realized by merely using the amine compound as a neutralizing agent. In other words, the amine compound must directly function as a dispersant of zinc phosphate. More specifically, it is believed that an excellent effect is realized through creating a state in which the amine compound that was free interacts with the phosphate particles.

DETAILED DESCRIPTION OF THE PREFERRED EMBODIMENTS

Figure 1:
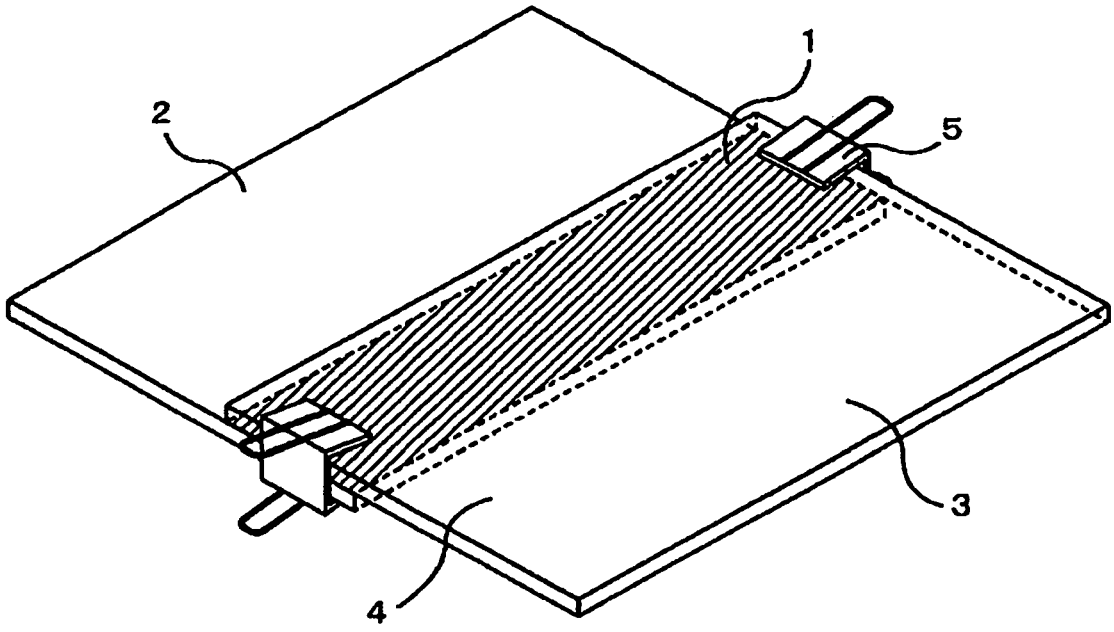
FIG. 1 shows a schematic drawing of an electrolytic corrosion aluminum test plate used in the Examples.

The present invention will be explained in more detail below by way of examples, but the present invention is not limited only to these examples. In the examples below, "part", or "%" each represents "part by weight", or "% by weight". Moreover, in the surface conditioning treatment, the treatment liquid actually brought into contact with the metal material is referred to as "treatment liquid for surface conditioning", while the dispersion liquid of the metal phosphate particles for use in producing the treatment liquid for surface conditioning through dilution is referred to as "concentrated dispersion liquid". The treatment liquid for surface conditioning is obtained by diluting the concentrated dispersion liquid with a solvent such as water to give a predetermined concentration, and adding the necessary additives followed by adjusting the pH.

EXAMPLE 1

To 79 parts by weight of pure water were added 20 parts by weight of zinc phosphate particles and 1 part by weight of N,N-dimethylethanolamine, and a dispersion was made with an SG mill for 180 min at a filling rate of zirconia beads (1 mm) of 80%. The resulting concentrated dispersion liquid was diluted with tap water to give a zinc phosphate concentration of 0.1%, and the treatment liquid for surface conditioning was obtained though adjusting the pH to 9 with dimethylethanolamine.

EXAMPLES 2, 3

To 79 parts by weight of pure water were added 20 parts by weight of zinc phosphate particles and 1 part by weight of triethanolamine (in Example 3, N-β(aminoethyl)ethanolamine was used), and a dispersion was made with an SG mill for 180 min at a filling rate of zirconia beads (1 mm) of 80%. The treatment liquid for surface conditioning was obtained by preparing it from the thus resulting concentrated dispersion liquid, in a similar manner to Example 1.

EXAMPLE 4

To 69 parts by weight of pure water were added 20 parts by weight of zinc phosphate particles, 10 parts by weight of triethanolamine and 1 part by weight of 3-mercaptopropylmethyldimethoxysilane, and a dispersion was made with an SG mill for 120 min at a filling rate of zirconia beads (1 mm) of 80%. The treatment liquid for surface conditioning was obtained by preparing it from the thus resulting concentrated dispersion liquid, in a similar manner to Example 1.

EXAMPLE 5

To 78 parts by weight of pure water was added 1 part by weight of saponite ("Sumecton SA", name of article, cation exchange capacity: 100 meq/100 g, average particle diameter in the dispersed state in water: 0.02 μm, manufactured by KUNIMINE INDUSTRIES CO., LTD.), and a preliminary dispersion was made with a disper at 3000 rpm. Thereafter, 1 part by weight of N,N-dimethylethanolamine and 20 parts by weight of zinc phosphate particles were added, and a dispersion was made with an SG mill for 180 min at a filling rate of zirconia beads (1 mm) of 80%. The treatment liquid for surface conditioning was obtained by preparing from the thus resulting concentrated dispersion liquid, in a similar manner to Example 1.

EXAMPLE 6

To 138 parts by weight of pure water were added 40 parts by weight of zinc phosphate particles and 2 parts by weight of N,N-dimethylethanolamine, and a dispersion was made with an SG mill for 120 min at a filling rate of zirconia beads (1 mm) of 80%. Thereafter, to the mixture was added 20 parts by weight of polyethyleneglycol ("Alumax R400", name of article, manufactured by Meiwa Kagaku Kogyo KK). The resulting concentrated dispersion liquid was diluted with tap water to give a zinc phosphate concentration of 0.1%, and the treatment liquid for surface conditioning was obtained though adjusting the pH to be 9 with NaOH.

EXAMPLE 7

3-Mercaptopropylmethyldimethoxysilane in an amount of 0.2 parts by weight and 1 part by weight of triethanolamine were preliminarily dispersed in 78.8 parts by weight of pure water with a disper at 3000 rpm. Thereafter, 20 parts by weight of zinc phosphate particles were added thereto, and a dispersion was made with an SG mill for 120 min at a filling rate of zirconia beads (1 mm) of 80%. After diluting the concentrated dispersion liquid in tap water to give a zinc phosphate concentration of 0.1%, 2 parts by weight of sodium tripolyphosphate was added thereto, and the pH of the mixture was adjusted to 9 with ammonia.

EXAMPLE 8

To 79 parts by weight of pure water were added 20 parts by weight of zinc phosphate particles and 1 part by weight of diethanolamine, and a dispersion was made with an SG mill for 120 min at a filling rate of zirconia beads (1 mm) of 80%. After diluting thus resulting concentrated dispersion liquid in pure water to give a zinc phosphate concentration of 0.1%, 2 parts by weight of a polyacrylic acid sulfonic acid copolymer ("Aron A6020", name of article, solid content: 40%, manufactured by Toagosei Chemical Industry Co., Ltd.) based on the solid content was added thereto, and the pH of the mixture was adjusted to 9 with diethanolamine (supra).

EXAMPLE 9

To 76.5 parts by weight of pure water were added 20 parts by weight of zinc phosphate particles, 1 part by weight of diethanolamine and 2.5 parts by weight of "Aron A6020" (supra), and a dispersion was made with an SG mill for 120 min at a filling rate of zirconia beads (1 mm) of 80%. The treatment liquid for surface conditioning was obtained by preparing it from the resulting concentrated dispersion liquid, in a similar manner to Example 1.

EXAMPLE 10

3-Mercaptopropylmethyldimethoxysilane in an amount of 1 part by weight and 1 part by weight of triethanolamine were preliminarily dispersed in 77 parts by weight of pure water with a disper at 3000 rpm. Thereafter, 20 parts by weight of zinc phosphate particles and 1 part by weight of carboxymethylcellulose (CMC) ("APP84", name of article, manufactured by Nippon Paper Industries Co., Ltd.) were added thereto, and a dispersion was made with an SG mill for 120 min at a filling rate of zirconia beads (1 mm) of 80%. The treatment liquid for surface conditioning was obtained by preparing it from the resulting concentrated dispersion liquid, in a similar manner to Example 1.

EXAMPLE 11

To 78 parts by weight of pure water were added 20 parts by weight of zinc phosphate particles, 1 part by weight of diethylethanolamine and 1 part by weight of an urethane resin ("TAFIGEL PUR40", name of article, manufactured by Kusumoto Chemicals, Ltd.), and a dispersion was made with an SG mill for 60 min at a filling rate of zirconia beads (1 mm) of 80%. The treatment liquid for surface conditioning was obtained by preparing from thus resulting concentrated dispersion liquid, in a similar manner to Example 1.

EXAMPLE 12

3-methacryloxypropylmethyltrimethoxysilane in an amount of 1 part by weight and 1 part by weight of triethanolamine were preliminarily dispersed in 77 parts by weight of pure water with a disper at 3000 rpm. Thereafter, 20 parts by weight of zinc phosphate particles and 1 part by weight of polyamide ("AQ-50", name of article, manufactured by Kusumoto Chemicals, Ltd.) were added thereto, and a dispersion was made with an SG mill for 120 min at a filling rate of zirconia beads (1 mm) of 80%. The treatment liquid for surface conditioning was obtained by preparing it from the resulting concentrated dispersion liquid, in a similar manner to Example 1.

EXAMPLE 13

To 31.7 parts by weight of pure water were added 3.3 parts by weight of triethanolamine and 65 parts by weight of zinc phosphate particles, and a dispersion was made with an SG mill for 180 min at a filling rate of zirconia beads (1 mm) of 80%. After diluting the dispersion in pure water two fold, the treatment liquid for surface conditioning was obtained by preparing it from the resulting concentrated dispersion liquid, in a similar manner to Example 1.

EXAMPLE 14

To 79.8 parts by weight of pure water were added 0.2 parts by weight of triethanolamine and 20 parts by weight of zinc phosphate particles, and a dispersion was made with an SG mill for 180 min at a filling rate of zirconia beads (1 mm) of 80%. The treatment liquid for surface conditioning was obtained by preparing it from the resulting concentrated dispersion liquid, in a similar manner to Example 1.

EXAMPLE 15

To 77.9 parts by weight of pure water was added 2 parts by weight of synthetic hectorite ("Laponite RD", name of article, cation exchange capacity: 120 meq/100 g, average particle diameter in the dispersed state in water: 0.05 μm, manufactured by Toshin Chemicals Co., Ltd.), and a preliminary dispersion was made with a disper at 3000 rpm. Thereafter, 0.1 parts by weight of triethanolamine and 20 parts by weight of zinc phosphate particles were added thereto, and a dispersion was made with an SG mill for 120 min at a filling rate of zirconia beads (1 mm) of 80%. The treatment liquid for surface conditioning was obtained by preparing it from the resulting concentrated dispersion liquid, in a similar manner to Example 1.

EXAMPLE 16

0.1 M zinc nitrate and 1 M monobasic sodium phosphate were mixed while stirring to allow precipitates to be produced by heating at 80° C. twice. Centrifugal separation (2000 ppm, for 5 min) and washing with water were repeated five times to produce a zinc phosphate paste. The zinc phosphate paste was adjusted to give a solid content concentration of 20 parts by weight and to include methyldiethanolamine at 1 part by weight, and dispersion was made similarly to Example 1. The treatment liquid for surface conditioning was obtained by preparing it from the resulting concentrated dispersion liquid, in a similar manner to Example 1.

EXAMPLE 17

To 78 parts by weight of pure water were added 1 part by weight of methyldiethanolamine, 20 parts by weight of zinc phosphate particles and 1 part by weight of gallic acid, and a dispersion was made with an SG mill for 120 min at a filling rate of zirconia beads (1 mm) of 80%. The treatment liquid for surface conditioning was obtained by preparing from the resulting concentrated dispersion liquid, in a similar manner to Example 1.

EXAMPLE 18

After diluting the concentrated dispersion liquid obtained in Example 17 with tap water to give a zinc phosphate concentration of 0.1%, epicatechin was further added thereto in an amount of 1 part by weight per 20 parts by weight of the zinc phosphate particles. The treatment liquid for surface conditioning was obtained through adjusting the pH to 9 with NaOH

COMPARATIVE EXAMPLE 1

To 79 parts by weight of pure water were added 1 part by weight of triethanolamine and 20 parts by weight of zinc phosphate particles, and a dispersion was made with an SG mill for 15 min at a filling rate of zirconia beads (1 mm) of 80% to obtain a concentrated dispersion liquid with a particle diameter of 3.9 μm. The treatment liquid for surface conditioning was obtained from the resulting concentrated dispersion liquid, in a similar manner to Example 1.

COMPARATIVE EXAMPLE 2

To 78 parts by weight of pure water was added 1 part by weight of colloidal silica ("Aerosil(R) 300", name of article, $SiO_2$, manufactured by NIPPON AEROSIL CO., LTD.), and a preliminary dispersion was made with a disper at 3000 rpm. Thereafter, 1 part by weight of sodium tertiary phosphate and 20 parts by weight of zinc phosphate particles were added thereto, and dispersion was made with an SG mill for 180 min at a filling rate of zirconia beads (1 mm) of 80%. The treatment liquid for surface conditioning was obtained by preparing it from the resulting concentrated dispersion liquid, in a similar manner to Example 1.

COMPARATIVE EXAMPLE 3

A preliminary dispersion of 5 parts by weight of a 20% polyallylamine solution ("PAA-03", name of article, molecular weight: 3000, solid content: 20%, manufactured by Toyobo Co., Ltd.) was prepared in 75 parts by weight of pure water, and thereto was added 20 parts by weight of zinc phosphate particles. Following dispersion with an SG mill for 180 min at a filling rate of zirconia beads (1 mm) of 80%, the treatment liquid for surface conditioning was obtained by preparing it from the resulting concentrated dispersion liquid, in a similar manner to Example 1.

COMPARATIVE EXAMPLE 4

To 76 parts by weight of pure water were added 4 parts by weight of 25% aqueous ammonia and 20 parts by weight of zinc phosphate particles, and a dispersion was made with an SG mill for 180 min at a filling rate of zirconia beads (1 mm) of 80%. The treatment liquid for surface conditioning was obtained by preparing it from the resulting concentrated dispersion liquid, in a similar manner to Example 0.1.

COMPARATIVE EXAMPLE 5

To 79 parts by weight of pure water was added 1 part by weight of carboxymethylcellulose (supra), and a preliminary dispersion was made with a disper at 3000 rpm. Then, 20 parts by weight of zinc phosphate particles were added thereto, and a dispersion was made with an SG mill for 360 min at a filling rate of zirconia beads (1 mm) of 80%. The treatment liquid for surface conditioning was obtained by preparing it from the resulting concentrated dispersion liquid, in a similar manner to Example 1.

COMPARATIVE EXAMPLE 6

To 77.5 parts by weight of pure water were added 20 parts by weight of zinc phosphate particles and 2.5 parts by weight of sodium polyacrylate having a molecular weight of 10,040, and a dispersion was made with an SG mill for 360 min at a filling rate of zirconia beads (1 mm) of 80%. The treatment liquid for surface conditioning was obtained by preparing it from the resulting concentrated dispersion liquid, in a similar manner to Example 1.

COMPARATIVE EXAMPLE 7

To 31.7 parts by weight of pure water were added 65 parts by weight of zinc phosphate particles and 3.3 parts by weight of carboxymethylcellulose (supra), and a dispersion was made with an SG mill for 180 min at a filling rate of zirconia beads (1 mm) of 80%. The treatment liquid for surface conditioning was obtained by preparing it from the resulting concentrated dispersion liquid, in a similar manner to Example 1.

COMPARATIVE EXAMPLE 8

A titanium-based powder surface conditioning agent ("5N10", name of article, manufactured by NIPPON PAINT CO., LTD.) was diluted with tap water to 0.1%, and the pH was adjusted to 9 with NaOH.

Production of Test Plate 1

A cold-rolled steel plate (SPC) (70 mm×150 mm×0.8 mm), an aluminum plate (Al) (#6000 series, 70 mm×150 mm×0.8 mm), a galvanized plate (GA) (70 mm×150 mm×0.8 mm), and a high-tensile steel plate (70 mm×150 mm×1.0 mm) were respectively subjected to a degreasing treatment using a degreasing agent ("SURFCLEANER EC92", name of article, 2%, manufactured by NIPPON PAINT CO., LTD.) at 40° C. for 2 min. Then, using the treatment liquid for surface conditioning of Examples 1 to 18 and Comparative Examples 1 to 8 obtained as described above, the surface conditioning treatment was carried out at room temperature for 30 sec. The compositions of the treatment liquids for surface conditioning obtained as in the foregoing are shown in Table 1. Subsequently, each steel plate was subjected to a conversion treatment using a zinc phosphate treatment liquid ("SURFDINE SD6350", name of article, manufactured by NIPPON PAINT CO., LTD.) with a dipping method at 35° C. for 2 min, followed by washing with water, washing with pure water, and drying to obtain a test plate.

Production of Test Plate 2

Similarly to the aforementioned Production of Test Plate 1, an aluminum plate 3 and a galvanized plate 2 subjected to the degreasing treatment were produced, and the aluminum plate 3 and the galvanized plate 2 following the degreasing treatment were joined using a clip 5 as shown in FIG. 1. Next, the joined steel plates were subjected, similarly to Production of Test Plate 1, to the surface conditioning treatment, a conversion treatment, washing with water, washing with pure water, and drying to obtain the test plate.

Evaluation Test

According to the following methods, the particle diameter and stability of the zinc phosphate particles of the resulting treatment liquids for surface conditioning were determined, and various evaluations of the test plates thus obtained were conducted. The results for the stability are shown in Table 3, while the other results are shown in Table 2. With respect to the steel plate produced in the "Production of Test Plate 2", the evaluation was made on a part of the electrolytic corrosion 1 of the aluminum plate 3. In Table 2, those produced in "Production of Test Plate 1" are designated as "SPC", "GA", "Al", and "high-tensile steel plate", while those produced in "Production of Test Plate 2" are designated as "Al (part of electrolytic corrosion)".

Determination of Particle Diameter of Zinc Phosphate Particles

With respect to particle diameters of the zinc phosphate particles included in the treatment liquid for surface conditioning obtained in the Examples or Comparative Examples, the particle diameter distribution was determined using an optical diffraction type particle size analyzer ("LA-500", name of article, manufactured by Horiba, Ltd.), and the $D_{50}$ (average particle diameter of dispersion) and $D_{90}$ were monitored to determine the $D_{50}$, and $D_{90}$.

Regarding Examples 1, 2, 3, 4, 5, 9 and 13, and Comparative Examples 5 and 6, the $D_{50}$ was measured one hour after initiating the dispersion.

Appearance of Coating Film

The appearance of the formed conversion coating film was visually evaluated on the basis of the following standards. Also, the presence or absence of the generation of rust after drying was observed. In the case in which rust was generated, it was designated as "generation of rust".

A: uniformly and minutely covering the entire face

B: roughly covering the entire face

C: parts were not covered

D: almost no conversion coating film formed

In addition, the size of the crystals of the formed conversion coating film was measured with an electron microscope.

Amount of Adhesion

After subjecting to the surface conditioning treatment and subsequently standing still for one hour followed by drying, the values of the adhesion were determined with a fluorescent X-ray measurement apparatus ("XRF-1700", name of article, manufactured by Shimadzu Corporation).

Amount of Conversion Coating Film

Using a fluorescent X-ray measurement apparatus ("XRF-1700", name of article, manufactured by Shimadzu Corporation), the mass of the conversion coating film was measured.

When metal materials that are comparatively excellent in conversion treatment capability such as SPC or GA were used, the conversion performance is considered to be higher as the particle diameter is smaller and as the amount of the coating film is smaller, because the formation of a crystal coating film as dense as possible is desired. In contrast, in the cases of conversion resistant metal materials such as the aluminum-based metal materials and the high-tensile steel plates, an increase in the amount of the crystal coating film is required because of low conversion treatment performance. Hence, a higher amount of the coating film is considered to show higher conversion performances.

Corrosion Resistance

The test plates following the conversion treatment were subjected to cation electrodeposition coating with a paint for cation electrodeposition paint ("POWERNIX 110", name of article, manufactured by NIPPON PAINT CO., LTD.) such that the dry film thickness became 20 μm. The test plates were produced by washing with water, and thereafter baking by heating at 170° C. for 20 min. After making two longitudinally parallel cuts so as to reach to the base material, they were subjected to a salt dip test (5% salt water, dipping for 480 hrs at 35° C.). Thereafter, tape stripping of the cut portions was performed, and the stripped width was evaluated.

Temporal Stability

Evaluation of the temporal stability of the treatment liquids for surface conditioning obtained in Examples 4, 6, 7, 11, 15, 19, and Comparative Examples 5, 8 was conducted by visually comparing the conversion capability of the SPC for the treatment liquid at room temperature after a lapse of 30 days with the initial conversion capability on the basis of the following standards.

A: appearance of the coating film being equivalent to initial one

B: coating film formed although inferior to initial one

C: almost no conversion coating film formed

TABLE 1

| | Phosphate | | Amine compound | | Metal alkoxide | | Layered clay mineral | |
|---|---|---|---|---|---|---|---|---|
| | Kind | Amount | Kind | Amount | Kind | Amount | Kind | Amount |
| Example 1 | Zinc phosphate | 20% | N,N-dimethylethanolamine | 1% | — | — | — | — |
| Example 2 | Zinc phosphate | 20% | triethanolamine | 1% | — | — | — | — |
| Example 3 | Zinc phosphate | 20% | N-β(aminoethyl)ethanolamine | 1% | — | — | — | — |
| Example 4 | Zinc phosphate | 20% | triethanolamine | 10% | 3-mercaptopropyl-methyldimethoxysilane | 1% | — | — |
| Example 5 | Zinc phosphate | 20% | N,N-dimethylethanolamine | 1% | — | — | saponite | 1% |
| Example 6 | Zinc phosphate | 20% | N,N-dimethylethanolamine | 1% | — | — | — | — |
| Example 7 | Zinc phosphate | 20% | triethanolamine | 1% | 3-mercaptopropyl-methyldimethoxysilane | 1% | — | — |
| Example 8 | Zinc phosphate | 20% | diethanolamine | 1% | — | — | — | — |
| Example 9 | Zinc phosphate | 20% | diethanolamine | 1% | — | — | — | — |
| Example 10 | Zinc phosphate | 20% | triethanolamine | 1% | 3-mercaptopropyl-methyldimethoxysilane | 1% | — | — |
| Example 11 | Zinc phosphate | 20% | diethanolamine | 1% | — | — | — | — |
| Example 12 | Zinc phosphate | 20% | triethanolamine | 1% | 3-mercaptopropyl-methyldimethoxysilane | 1% | — | — |
| Example 13 | Zinc phosphate | 65% | triethanolamine | 3.3% | — | — | — | — |

TABLE 1-continued

| | | | | | | | | |
|---|---|---|---|---|---|---|---|---|
| Example 14 | Zinc phosphate | 20% | triethanolamine | 0.2% | — | — | — | — |
| Example 15 | Zinc phosphate | 20% | triethanolamine | 0.1% | — | — | synthetic hectorite | 2% |
| Example 16 | Zinc phosphate | 20% | methyldiethanolamine | 1% | — | — | — | — |
| Example 17 | Zinc phosphate | 20% | methyldiethanolamine | 1% | — | — | — | — |
| Example 18 | Zinc phosphate | 20% | methyldiethanolamine | 1% | — | — | — | — |
| Comparative Example 1 | Zinc phosphate | 20% | triethanolamine | 1% | — | — | — | — |
| Comparative Example 2 | Zinc phosphate | 20% | tribasic sodium phosphate | 1% | — | — | — | — |
| Comparative Example 3 | Zinc phosphate | 20% | polyallylamine | 1% | — | — | — | — |
| Comparative Example 4 | Zinc phosphate | 20% | ammonia | 1% | — | — | — | — |
| Comparative Example 5 | Zinc phosphate | 20% | — | — | — | — | — | — |
| Comparative Example 6 | Zinc phosphate | 20% | — | — | — | — | — | — |
| Comparative Example 7 | Zinc phosphate | 65% | — | — | — | — | — | — |
| Comparative Example 8 | | | Powder surface conditioning agent-5N10 (0.1%) initial make-up of bath | | | | | |

| | Other additive | | Dispersion | Particle diameter (1 hr) | Particle diameter (final) | | |
|---|---|---|---|---|---|---|---|
| | Kind | Amount | time (min) | $D_{50}$ | $D_{50}$ | $D_{90}$ | pH |
| Example 1 | — | — | 180 | 0.82 | 0.49 | 0.83 | 9 |
| Example 2 | — | — | 180 | 0.91 | 0.42 | 0.73 | 9 |
| Example 3 | — | — | 180 | 0.78 | 0.47 | 0.79 | 9 |
| Example 4 | — | — | 120 | 0.82 | 0.42 | 0.72 | 9 |
| Example 5 | — | — | 120 | 0.80 | 0.39 | 0.73 | 9 |
| Example 6 | polyethyleneglycol | 10% | 120 | — | 0.45 | 0.76 | 9 |
| Example 7 | tripolyphosphate Na (added after dilution) | 2% | 120 | — | 0.42 | 0.72 | 9 |
| Example 8 | Aron A6020 (added after dilution) | 2% | 120 | — | 0.42 | 0.73 | 9 |
| Example 9 | Aron A6020 | 1% | 120 | 0.82 | 0.49 | 0.83 | 9 |
| Example 10 | CMC(APP84) | 1% | 120 | — | 0.50 | 0.84 | 9 |
| Example 11 | urethan resin | 0.3% | 120 | — | 0.42 | 0.79 | 9 |
| Example 12 | polyamide(AQ-50) | 0.3% | 60 | — | 0.47 | 0.76 | 9 |
| Example 13 | — | — | 180 | 0.81 | 0.44 | 0.79 | 9 |
| Example 14 | — | — | 180 | — | 0.51 | 0.73 | 9 |
| Example 15 | — | — | 120 | — | 0.47 | 0.79 | 9 |
| Example 16 | — | — | 180 | — | 0.42 | 0.73 | 9 |
| Example 17 | gallic acid | 1% | 120 | — | 0.47 | 0.79 | 9 |
| Example 18 | gallic acid<br>epicatechin (added after dilution) | 1%<br>1% | 120 | — | 0.7 | 0.79 | 9 |
| Comparative Example 1 | — | — | 15 | — | 3.90 | 6.3 | 9 |
| Comparative Example 2 | $SiO_2$ (Aerosil 300) | 1% | 180 | — | 2.30 | 4.6 | 9 |
| Comparative Example 3 | — | — | 180 | — | 5.60 | 18.6 | 9 |
| Comparative Example 4 | — | — | 180 | — | aggregation | aggregation | 9 |
| Comparative Example 5 | CMC(APP84) | 1% | 360 | 1.58 | 0.59 | 1.15 | 9 |
| Comparative Example 6 | acrylic acid Na | 1% | 360 | 1.52 | 0.51 | 1.12 | 9 |
| Comparative Example 7 | CMC(APP84) | 3.3% | 180 | — | aggregation | aggregation | 9 |
| Comparative Example 8 | Powder surface conditioning agent-5N10 (0.1%) initial make-up of bath | | — | — | — | — | 9 |

Particle diameter (1 hr): Particle diameter 1 hr after initiating dispersion (μm), Particle diameter (final): Particle diameter of condensed dispersion liquid (μm)

TABLE 2

| | Appearance of film | | | | Appearance of film (crystal) μm | | | | Amount of adhesion ($mg/m^2$) | |
|---|---|---|---|---|---|---|---|---|---|---|
| | SPC | GA | Al (Partr of electrolytic corrosion) | High-tensile steel plate | SPC | GA | Al (Part of electrolytic corrosion) | High-tensile steel plate | SPC | Al |
| Example 1 | A | A | A | A | <1 | about 1 | 2-5 | — | — | — |
| Example 2 | A | A | A | A | <1 | about 1 | 2-5 | <1 | 12 | 11 |
| Example 3 | A | A | A | A | <1 | about 1 | 2-5 | — | — | — |
| Example 4 | A | A | A | A | <1 | about 1 | 2-5 | <1 | 17 | 14 |
| Example 5 | A | A | A | A | <1 | about 1 | 2-5 | — | — | — |
| Example 6 | A | A | A | A | <1 | about 1 | 2-5 | — | — | — |
| Example 7 | A | A | A | A | <1 | about 1 | 2-5 | <1 | 13 | 16 |
| Example 8 | A | A | A | A | <1 | about 1 | 2-5 | — | — | — |
| Example 9 | A | A | A | A | <1 | about 1 | 2-5 | — | — | — |
| Example 10 | A | A | A | A | <1 | about 1 | 2-5 | — | — | — |
| Example 11 | A | A | A | A | <1 | about 1 | 2-5 | — | — | — |
| Example 12 | A | A | A | A | <1 | about 1 | 2-5 | <1 | 15 | 14 |
| Example 13 | A | A | A | A | <1 | about 1 | 2-5 | <1 | 13 | 13 |
| Example 14 | A | A | A | A | <1 | about 1 | 2-5 | — | — | — |
| Example 15 | A | A | A | A | <1 | about 1 | 2-5 | <1 | 15 | 14 |
| Example 16 | A | A | A | A | <1 | about 1 | 2-5 | — | — | — |
| Example 17 | A | A | A | A | <1 | about 1 | 2-5 | — | — | — |
| Example 18 | A | A | A | A | <1 | about 1 | 2-5 | — | — | — |
| Comparative Example 1 | generation of rust | D | D | — | — | — | — | — | — | — |
| Comparative Example 2 | generation of rust | D | D | — | — | — | — | — | — | — |
| Comparative Example 3 | generation of rust | D | D | — | — | — | — | — | — | — |
| Comparative Example 4 | generation of rust | D | D | — | — | — | — | — | — | — |
| Comparative Example 5 | B | B | B | C partly rusted | 1-2 | 2-5 | 5-10 | 2-5 | 1.5 | 0.8 |
| Comparative Example 6 | B | B | B | C partly rusted | 1-2 | 2-5 | 5-10 | 2-5 | 1.2 | 1.0 |
| Comparative Example 7 | generation of rust | D | D | — | — | — | — | — | — | — |
| Comparative Example 8 | B | B | D | generation of rust | 2 | 2-5 | x | — | 1 or less | 1 or less |

| | Amount of coating film ($mg/m^2$) | | | | Corrosion resistance SDT 480 h | |
|---|---|---|---|---|---|---|
| | SPC | GA | Al | Al (Part of electrolytic corrosion) | SPC | High-tensile steel plate |
| Example 1 | — | — | — | — | — | — |
| Example 2 | 1.6 | 2.3 | — | 1.6 | 0 mm | 0 mm |
| Example 3 | — | — | — | — | — | — |
| Example 4 | 1.5 | 2.2 | — | 1.7 | 0 mm | 0 mm |
| Example 5 | — | — | — | — | — | — |
| Example 6 | — | — | — | — | — | — |
| Example 7 | 1.5 | 2.3 | — | 1.6 | 0 mm | 0 mm |
| Example 8 | — | — | — | — | — | — |
| Example 9 | — | — | — | — | — | — |
| Example 10 | — | — | — | — | — | — |
| Example 11 | — | — | — | — | — | — |
| Example 12 | 1.6 | 2.4 | — | 1.7 | 0 mm | 0 mm |
| Example 13 | 1.6 | 2.4 | 1.6 | 1.6 | — | — |
| Example 14 | — | — | — | — | — | — |
| Example 15 | 1.5 | 2.3 | — | 1.6 | 0 mm | 0 mm |
| Example 16 | — | — | — | — | — | — |
| Example 17 | — | — | — | — | — | — |
| Example 18 | — | — | — | — | — | — |
| Comparative Example 1 | — | — | — | — | — | — |
| Comparative Example 2 | — | — | — | — | — | — |
| Comparative Example 3 | — | — | — | — | — | — |
| Comparative Example 4 | — | — | — | — | — | — |
| Comparative Example 5 | 1.9 | 3.1 | — | 0 | 1 mm | 3 mm |
| Comparative Example 6 | 1.9 | 3.2 | — | 0 | — | — |

TABLE 2-continued

| | | | | | | |
|---|---|---|---|---|---|---|
| Comparative Example 7 | — | — | — | — | — | — |
| Comparative Example 8 | 2.0 | 3.3 | — | 0 | 1 mm | 4 mm |

TABLE 3

| | Temporal stability |
|---|---|
| Example 4 | A |
| Example 6 | A |
| Example 7 | A |
| Example 11 | A |
| Example 15 | A |
| Example 18 | A |
| Comparative Example 5 | B |
| Comparative Example 8 | C |

As shown in Table 1, according to the method for production of the present invention, a composition for surface conditioning including zinc phosphate particles having an intended particle diameter could be obtained in a period of time shorter than conventional methods. Also, as shown in Example 13, even though the dispersion was made with a zinc phosphate at a high concentration of 65%, a favorable composition for surface conditioning could be obtained. In contrast, in Comparative Example 7 in which a similar experiment was carried out using carboxymethylcellulose in place of the amine compound, the aggregation of the metal phosphate particles resulted in a failure in obtaining favorable dispersion, and thus a composition for surface conditioning could not be obtained.

Also, as shown in Table 2, when the composition for surface conditioning of the present invention was used, a conversion coating film in a sufficient amount of the coating film was formed on all of the cold-rolled steel plates, aluminum plates, and galvanized plates, and furthermore, a conversion coating film in a sufficient amount of the coating film was formed also on a part of the aluminum plate at the part of contact with different kinds of metals, i.e., the aluminum plate and the galvanized plate. In other words, even though different kinds of metal materials were simultaneously subjected to the treatment, the conversion coating film in a sufficient amount of the coating film could be formed.

Moreover, as shown in Table 3, the composition for surface conditioning of the present invention is excellent in temporal stability. Even though the treatment liquid for surface conditioning was used 30 days after the preparation, the conversion coating film could be favorably formed.

The composition for surface conditioning obtained by the method for production of the present invention can be suitably used for a variety of metal materials which have been employed in automotive bodies, home electric appliances, and the like.

What is claimed is:

1. A composition for surface conditioning comprising bivalent or trivalent metal phosphate particles and having a pH of 3 to 12, wherein a $D_{50}$ of the bivalent or trivalent metal phosphate particles is 3 μm or less, and the composition for surface conditioning comprises an amine compound having a molecular weight of 1000 or less, and at least one metal alkoxide in a content of from 0.01 to 1000 parts by weight per 100 parts by weight of the solid content of the metal phosphate particles and having the following formula:

$$R^1\text{-}M\text{-}(R^2)_n(OR^2)_{3-n}$$

wherein M represents silicon, titanium or aluminum; $R^1$ represents an alkyl group having 1 to 6 carbon atoms and being unsubstituted or substituted with an organic group, an epoxyalkyl group having 1 to 11 carbon atoms, an aryl group, an alkenyl group having 1 to 11 carbon atoms, an aminoalkyl group having 1 to 5 carbon atoms, a mercaptoalkyl group having 1to 5 carbon atoms, or a halogenoalkyl group having 1 to 5 carbon atoms; $R^2$ represents an alkyl group having 1 to 6 carbon atoms; and n is 0, 1, or 2.

2. A composition for surface conditioning according to claim 1 wherein the bivalent or trivalent metal phosphate particle is zinc phosphate.

3. A composition for surface conditioning according to claim 1 wherein the amine compound is a hydroxyamine compound having at least one hydroxyl group per molecule.

4. A composition for surface conditioning according to claim 2 wherein the amine compound is a hydroxyamine compound having at least one hydroxyl group per molecule.

5. A composition for surface conditioning according to claim 1 further comprising a layered clay mineral.

6. A composition for surface conditioning according to claim 1 further comprising a chelating agent.

7. A composition for surface conditioning according to claim 1 further comprising a phenolic compound.

8. A composition for surface conditioning according to claim 1, wherein the metal alkoxide is an alkoxysilane compound having at least one mercapto group or (meth)acryloxy group.

9. A composition for surface conditioning according to claim 1, wherein the metal alkoxide is present in a content of from 0.1 to 100 parts by weight per 100 parts by weight of the solid content of the metal phosphate particles.

10. A composition for surface conditioning according to claim 9, wherein the metal alkoxide is present in a content from 0.5 to 20 parts by weight per 100 parts by weight of the solid content of the metal phosphate particles.

11. A composition for surface conditioning according to claim 1, further comprising a surfactant, wherein the amine is present in the form of free amine when the surfactant is anionic.

12. A composition for surface conditioning according to claim 11, further comprising amine-based neutralizing agent is selected from at least one of diethylamine, triethylamine, monoethanolamine, diethanolamine, triethanolamine, dimethylethanolamine, diethylethanolamine, isopropylethanolamine, diisopropanolamine, 2-amino-2-methylpropanol, 2-(dimethylamino)-2-methylpropanol, morpholine, N-methylmorpholine and N-ethylmorpholine.

13. A composition for surface conditioning according to claim 1, wherein the amine is present in a content from 0.01 to 1000 parts by weight per 100 parts by weight of the solid content of the metal phosphate particles.

14. A composition for surface conditioning according to claim 13, wherein the amine is present in a content from 0.1 to 100 parts by weight per 100 parts by weight of the solid content of the metal phosphate particles.

15. A composition for surface conditioning according to claim 14, wherein the amine is present in a content from 0.5 to 50 parts by weight per 100 parts by weight of the solid content of the metal phosphate particles.

* * * * *